US005967828A

United States Patent [19]

Geurts et al.

[11] Patent Number: 5,967,828

[45] Date of Patent: Oct. 19, 1999

[54] MODULAR PLUG FOR HIGH SPEED DATA TRANSMISSION

[75] Inventors: Gerardus Hubertus Johannes Geurts, Stanmore; Brian Donald Stephenson, Radlett, both of United Kingdom

[73] Assignee: The Whitaker Corporation, Wilmington, Del.

[21] Appl. No.: 08/952,062

[22] PCT Filed: May 14, 1996

[86] PCT No.: PCT/IB96/00447

§ 371 Date: Nov. 6, 1997

§ 102(e) Date: Nov. 6, 1997

[87] PCT Pub. No.: WO96/37015

PCT Pub. Date: Nov. 21, 1996

[30] Foreign Application Priority Data

May 16, 1995 [GB] United Kingdom ..... 9509886

[51] Int. Cl.[6] ..... H01R 4/24

[52] U.S. Cl. ..... 439/418

[58] Field of Search ..... 439/418, 676, 439/941

[56] References Cited

U.S. PATENT DOCUMENTS

| | | | |
|---|---|---|---|
| 5,041,010 | 8/1991 | Collier | 439/418 |
| 5,226,835 | 7/1993 | Baker | 439/403 |
| 5,284,447 | 2/1994 | Kristiansen | 439/676 |
| 5,362,257 | 11/1994 | Neal et al. | 439/676 |
| 5,716,237 | 2/1998 | Conorich et al. | 439/660 |
| 5,762,516 | 6/1988 | Itoga et al. | 439/404 |

FOREIGN PATENT DOCUMENTS 2271678 4/1994 United Kingdom .

*Primary Examiner*—Paula Bradley
*Assistant Examiner*—Truc T. Nguyen
*Attorney, Agent, or Firm*—Driscoll A. Nina

[57] ABSTRACT

A modular plug comprises an insulative housing having a plurality of contacts that have a mating portion and an insulation piercing portion similar to that of conventional modular plugs where the terminals are further provided with capacitor plate portions that are connected to the mating portions via linking portions which cross-over that of an adjacent contact, for at least some of the terminals, in order to provide capacitive coupling between certain contacts to reduce cross-talk.

7 Claims, 2 Drawing Sheets

MODULAR PLUG FOR HIGH SPEED DATA TRANSMISSION

BACKGROUND OF THE INVENTION

1. Field of the Invention

This invention relates to connectors provided with means for reducing cross-talk, to enable high speed data transmission.

2. Summary of the Prior Art

There is an increase in demand for cable and connection systems to transmit digital signals at high speeds. As frequency increases, emission of "noise" increases, and this is a particular problem for closely positioned conductors which are subject to what is called cross-talk. Beyond a certain transmission frequency, cross-talk becomes unacceptably intense and thus limits the speed of data transmission. In cables, one of the ways of reducing cross-talk is by twisting pairs of conductors, where one conductor of the pair is for transmitting a positive signal, and the other conductor for transmitting a negative signal of equal intensity and timing as the positive signal. This is called a differential pair due to the nature of the opposed signals in the pair. Due to the twisting about each other, magnetic and electrical fields emitted from each of the cables cancel each other out and thus noise emitted from the pair is very low. Such pairs can thus be placed within a cable and positioned closely together whilst nevertheless transmit high speed electrical signals.

One of the problems however occurs at the connection end, where the conductors are connected to terminals within the connector. Terminals of connectors are often positioned in juxtaposed parallel relationships, and exhibit more cross-talk than between conductors of the cable. One way of reducing cross-talk effects is shown in European Patent Publication No. 583 111 where conductor pairs of a connector are crossed-over, thus behaving in a similar manner to that of a twisted cable. Crossing-over of contacts in connectors is also shown in U.S. Pat. No. 5,186,647. The latter shows cross-talk reduction in a modular jack, which is a standardized connector widely used in telecommunications and computer data interconnection systems. Standardized modular jacks and corresponding plugs for connection thereto, were initially designed and used for low speed data transmission systems, and are thus not necessarily the most effective connection systems for use with high speed data transmission. Due to their widespread use however, there is a need to improve the data transmission speed capabilities of modular plug and jack connectors whilst respecting the standardized interface requirements.

Another means of reducing cross-talk is by judicious capacitive or inductive coupling between conductors of the connector as shown in U.S. Pat. No. 5,326,284. In the latter, the connector (modular jack) is positioned on a printed circuit board (PCB) having circuit traces thereon that are arranged in such a manner to couple the conductors by means of inductances and capacitances. The purpose of the coupling is to neutralize cross-talk present in the line by further coupling of the conductors to an opposite signal of equal intensity (a differential signal). Furthermore, the capacitances and inductances can be adjusted to match the impedance of the connector with that of the cable to reduce reflection of signals. Provision of a PCB however requires an extra component and increases the cost of the connector assembly. Furthermore, the volume of the connector is also increased. The latter also means that some connectors cannot be provided with a PCB, for example provision of a PCB in a modular plug would not be feasible.

G.B.-A-2 271 678 shows a modular jack with terminal contacts having a mating portion, an IDC wire connection portion, and capacitance portions extending integrally via linking portions therebetween. The capacitance portions are laterally offset from their mating portions and are positioned over the capacitance plates or the other contacts, for the purpose of reducing crosstalk between conductor pairs.

U.S. Pat. No. 5,226,835 shows a four conductor patch plug having terminals with a contact portion and an IDC wire connection portion, adjacent terminals being crossed over at a mid-portion between contact and connection portions thereby adding a controlled half-twist to conductor pairs to reduce crosstalk.

It would be desirable to have an interconnection system that is not only cost-effective, but also compact and that is for high speed data transmission, the connector thus having reduced cross-talk and controlled impedance. It would also be desirable to provide the latter aspects in a standardized modular plug connector.

It is an object of this invention to provide a compact and cost-effective connector for high speed signal transmission.

It is an object of this invention to provide a standardized modular plug capable of high speed data transmission.

It is a further object of this invention to provide a compact and cost-effective means for reducing cross-talk in a connector for differential signal transmission, and that can be impedance matched with a cable connection thereto.

Objects of this invention have been achieved by providing a connector comprising an insulative housing and a plurality of juxtaposed contacts mounted thereon, the contacts having a wire connection portion and a mating portion for contact with terminals of a complementary connector, the contacts further comprising plate portions for capacitive coupling between contacts. In an advantageous embodiment, the contacts are stamped and formed from sheet metal, and are mounted in a standardized modular plug connector. Some of the contacts of the connector may comprise thin extensions between the contact portions and plate portions, whereby the thin extensions allow a cross-over in the position of the plate portion with respect to the contact portion such that the corresponding contact can be capacitively coupled to another contact beyond the adjacent contact. The mating portion and connection portions of the contact could be substantially planar, whereby the connection portion comprises insulation piercing contacts for connection by means of piercing to conducting strands of insulated conducting wires, and the mating portion comprises an arcuate edge of the contact. In the latter disposition, the capacitance plate portion would extend rearwardly, away from the mating end of the connector, and positionable above wires of a cable for connection to the plug, such that a compact arrangement is achieved.

DETAILED DESCRIPTION OF THE PREFERRED EMBODIMENT

Figure 2A:
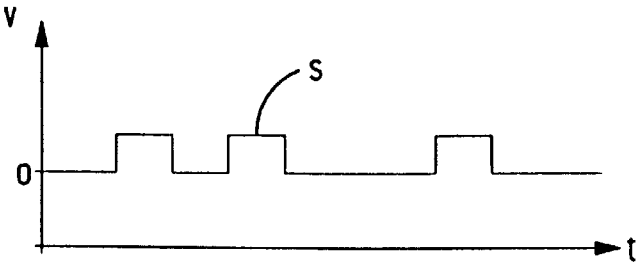
FIG. 2*a* and 2*b* are schematic examples of respective signals transmitted along a differential pair.
Figure 2B:
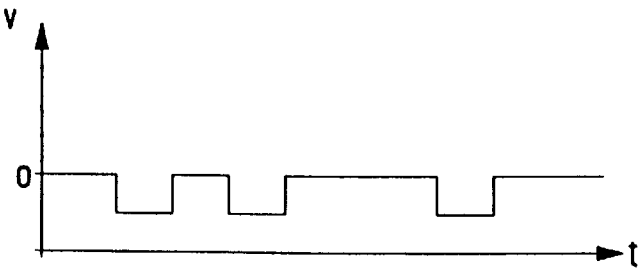
Figure 1:
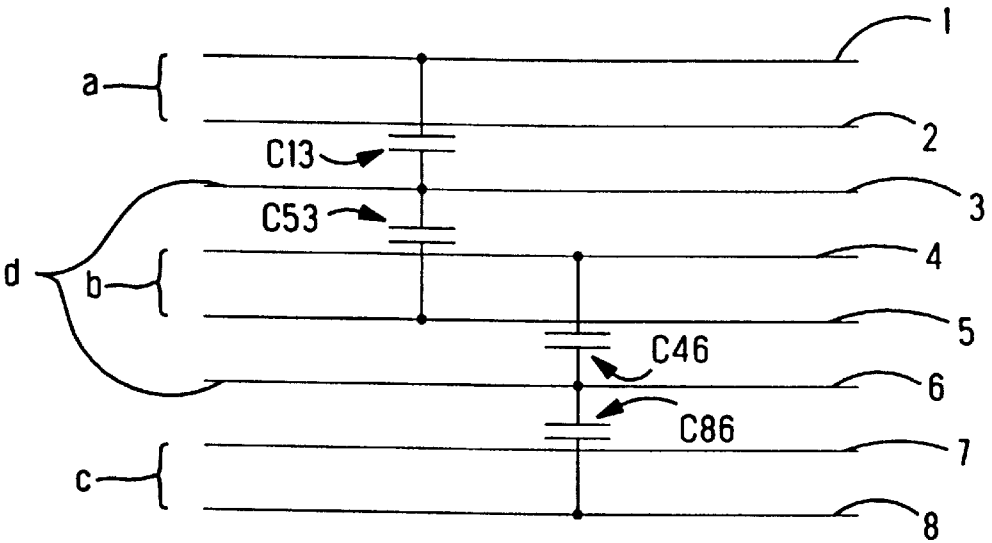
FIG. 1 is a simplified electrical schema of a capacitance coupling arrangement that can be achieved with this invention.

Referring first to FIG. 1, eight conductors are represented by the lines numbered 1–8 of a conductor are shown. These eight conductors belong to four differential pairs A, B, C and D respectively. Signals are transmitted by the conductor pairs in a differential manner whereby one conductor of a pair carries positive voltage signals as illustrated in the FIG. 2A by the signals S, and the other conductor of the pair carries a signal of equal intensity and timing, but with a negative voltage with respect to the other conductor. In a twisted pair cable, as the differential pairs are twisted about each other, emission of electromagnetic noise from each of the wires of the pair cancel each other out thus allowing high speed data transmission.

At the connector, however, the wire ends are straightened and generally positioned in a juxtaposed manner, an example of which is illustrated in FIG. 1 by the conductors 1–8. Due to this juxtaposed positioning of the conductors, there is unbalanced cross-talk between conductors. As an example to explain this more clearly, consider the cross-talk between conductor 3 and the differential pair A (conductors 1,2). Conductor 3 is positioned closer to conductor 2 than to conductor 1, and therefore the noise influence of conductor 2 on conductor 3 is greater than that of conductor 1 on conductor 3. By placing a capacitance C13 between conductors 1 and 3, some of the energy of a signal being transmitted along conductor 1 is capacitively fed into conductor 3, and if the capacitance C13 is correctly dimensioned, the additional coupled signal will cancel out the noise from conductor 2 because of their opposed potential differences. The influence of the differential pair B (conductors 4,5) on conductor 3 has a similar effect, which is balanced by the capacitance C53 between conductors 3 and 5. With a similar reasoning, positioning of capacitive coupling C46 between conductors 4 and 6 and C86 between conductors 6 and 8 balances the influence of pairs B and C respectively on conductor 6. Cross-talk is thus substantially reduced between differential pairs A and D, C and D, and B and D. The differential pairs A, B and C are spaced further apart from each other, and are therefore less effected by cross-talk, in particular because the magnetic and electrical fields generated by conductors reduce in-strength proportionally to the square of the distance (generally speaking).

Figure 3:
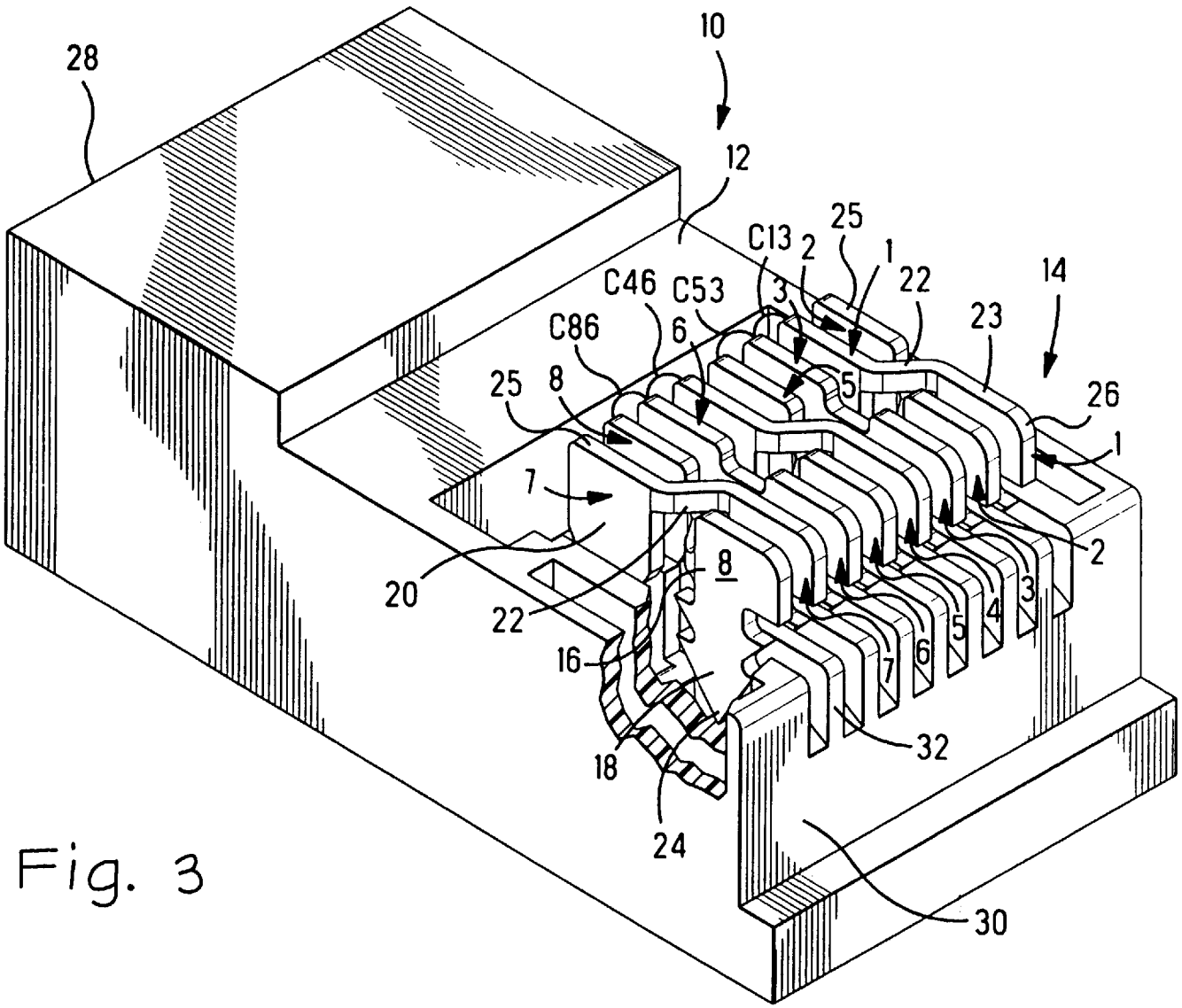
FIG. 3 is an isometric view of a modular plug according to this invention with the contacts shown disassembled from the housing.

Referring to FIG. 3, a modular plug connector 10 is shown comprising an insulative housing 12 and a plurality of stamped and formed contacts 14 that are numbered 1–8 corresponding to the layout of FIG. 1. Each of the contacts 14 has a mating portion 16, a connection portion 18 and a capacitor plate portion 20 connected to the mating portion via a linking portion 22. The connection portions 18 may be provided with insulation piercing tips 24 such that the contacts 14 can be pressed onto insulated conducting wires positioned thereunder. A tool is positioned against an upper edge 23 of the mating portion 16, which is aligned with an upper tool pressure edge 25 of the capacitor plate portion 20, for driving the insulation piercing tips 24 into the wire conductors positioned therebelow in conductor receiving cavities of the housing 12. The insulation piercing tips 24 pierce through the wire insulation and contact the inner conducting strands thereof.

The mating and connection portions 16,18 are similar in design to those of conventional modular plugs, whereby the modular plug 10 is matable to a conventional modular jack. Electrical connection between the modular plug 10 and spring contacts of the modular jack is effectuated by abutment of the modular jack spring contacts against arcuate contact surfaces 26 of the mating portion 16. The conducting wires are received within the housing 10 from a wire receiving end 28 in cavities that extend upward to proximate the mating end 30 and extending below the insulation piercing tips 24. Wires of the cable can thus be inserted below the contacts 14 which are then depressed for contact to the conducting wires. Each of the contacts 14 is separated from an adjacent contact by insulative wall portions 32, which laterally support the contact mating portion 16.

In order to provide the capacitance C13 as shown in FIG. 1, the contact number 1 has a linking portion 22 that is oblique such that the plane of the plate portion 20 is offset from the plane of the contact portion 16 by the distance of the pitch between contacts of the connector. In a similar manner, the contact number 2 has a capacitor plate portion that is obliquely offset with respect to the mating portion in the direction of the first contact. The capacitance plate portion 20 of terminal 1 is thus positioned adjacent that of terminal 3 which is generally planar in shape. In order to provide the capacitance C53, plate portion 20 of terminal 5 is offset from the mating portion 16 and likewise for terminal 4 such that capacitor plate portion of terminal 5 is adjacent that of terminal 3, and capacitor plate portion of terminal 4 is adjacent that of terminal 6, terminal 6 being similar to that of terminal 3 in such that it is substantially planar. Terminals 7 and 8 have a similar arrangement as that of terminals 1 and 2 respectively. Terminals 1, 4 and 7 have thin linking portions 22 positioned over and across the linking portions 22 of terminals 2, 5 and 8 respectively which are positioned at a lower height to enable the cross-over of the linking portions thereof.

In order to achieve the electrical set-up as illustrated in FIG. 1, plate portions of terminals 2 and 7 are not required, however in this embodiment it is not necessary to move them and as they are similar to other terminals, leaving them on is more cost-effective than removing them.

As the capacitor plate portions 20 are positioned rearwardly of the contact mating portion 16 with respect to the mating face 30, a compact arrangement is achieved whilst allowing mating with a standard modular jack: in other words the connector 10 may have a standardized interface. The capacitor plate portions 20 are positioned above the conducting wires and do not increase the space requirements of the connector 10. Furthermore, the contacts are simple unitary stamped and formed parts that can be easily assembled to the housing 12.

Advantageously therefore, this invention allows a very compact contact arrangement whilst nevertheless providing capacitive coupling of contacts for cross-talk reduction and connector-cable impedance matching. The simple stamped and formed unitary contacts are cost-effective to manufacture and assemble, and enable provision of standardized modular plug for coupling to a standardized modular jack.

We claim:

1. A modular plug connector for connection to a complementary modular jack connector, comprising: an insulative housing having a plurality of wire receiving cavities arranged adjacently for receiving conducting wires therein and a plurality of spaced-apart wall portions positioned above and between the wire receiving cavities to define terminal receiving cavities directly above corresponding wire receiving passageways; and, a plurality of juxtaposed stamped and formed terminals positioned in the terminal receiving cavities of the housing, where each terminal has a body with a wire connection portion that includes a insulation piercing tip a mating portion directly above the wire connection portion that includes a connection surface for contact with a corresponding terminal of the complementary modular jack connector and an upper edge for positioning a tool thereagainst for driving the insulation piercing tip into the corresponding conductive wire therebelow, and a capacitance plate portion connected to the mating portion by a linking: portion and extending behind the mating portion, as defined by the connection direction of the modular plug connector and the complementary modular jack connector, where the capacitance plate portion of at least one of the terminals is aligned with and disposed behind the mating portion of another one of the plurality of terminals than the mating portion to which the capacitance plate portion is connected to by way of the linking portion.

2. The connector of claim 1 wherein the capacitance plate portions are integrally stamped and formed from sheet metal with respective said mating portions.

3. The connector of claim 1 wherein the capacitance plate portions are positioned above the wire receiving cavities.

4. The connector of claim 1 wherein the capacitance plate portions are planar.

5. The connector of claim 1 wherein some of the terminals' linking portions cross over above and are spaced from the linking portions of adjacent terminals.

6. The connector of claim 1 wherein the capacitance plate portions extend in a juxtaposed parallel manner, from proximate an outer surface of the housing towards the conductor receiving passages of the housing.

7. The connector of claim 1 wherein the capacitance plate portions have an upper edge aligned with the upper edge of the mating portion.

* * * * *